US009797154B1

(12) United States Patent
McKinney et al.

(10) Patent No.: US 9,797,154 B1
(45) Date of Patent: Oct. 24, 2017

(54) MODULAR TEMPORARY ROOF COVERING SYSTEMS

(71) Applicants: Jason McKinney, Ridgefield, WA (US); Richard Wallway, Ridgefield, WA (US)

(72) Inventors: Jason McKinney, Ridgefield, WA (US); Richard Wallway, Ridgefield, WA (US)

( * ) Notice: Subject to any disclaimer, the term of this patent is extended or adjusted under 35 U.S.C. 154(b) by 0 days.

(21) Appl. No.: 15/393,067

(22) Filed: Dec. 28, 2016

(51) Int. Cl.

| | |
|---|---|
| ***E04H 15/02*** | (2006.01) |
| ***E04G 21/24*** | (2006.01) |
| ***E04D 15/00*** | (2006.01) |
| ***E04H 15/54*** | (2006.01) |
| *E04H 15/32* | (2006.01) |

(52) U.S. Cl.
CPC ..... *E04H 15/02* (2013.01); *E04D 15/00* (2013.01); *E04G 21/24* (2013.01); *E04H 15/54* (2013.01); *E04G 2021/248* (2013.01); *E04H 15/322* (2013.01); *Y10S 52/12* (2013.01)

(58) Field of Classification Search
CPC ..... E04H 15/02; E04H 15/322; E04H 15/54; E04G 21/24; E04G 21/32; E04G 2021/248; E04D 15/00
USPC ..... 52/3, 4, 23, DIG. 12, DIG. 14
See application file for complete search history.

(56) References Cited

U.S. PATENT DOCUMENTS 2,988,096 A * 6/1961 Otto ..... E04B 1/342 135/115
5,579,794 A * 12/1996 Sporta ..... E02D 5/801 135/115
5,799,680 A * 9/1998 Dorflinger ..... E04G 5/12 135/116
5,862,633 A * 1/1999 Van Ells ..... E03B 3/02 135/117
7,264,012 B2 * 9/2007 Slade ..... E04G 21/28 135/900
7,310,913 B2 * 12/2007 Pierce ..... E04H 9/14 52/148
7,392,620 B1 * 7/2008 Watson, Jr. ..... E04H 9/14 52/23
7,578,100 B2 * 8/2009 Sicurella ..... E04H 9/14 52/3

(Continued)

*Primary Examiner* — Robert Canfield
(74) *Attorney, Agent, or Firm* — Mohr Intellectual Property Law Solutions, PC

(57) ABSTRACT

In one embodiment, a roof covering system includes at least two ridge post members, a tarp at least two cables, at least two poles, at least two pole attachment members, and at least two winches. Each ridge post member may include a base configured to attach to a ridge of a roof, a head member; and a post having a bottom end and a top end, the bottom end secured to the base, and the top end secured to the head member. The tarp may have a top edge and a bottom edge, and connection points disposed near the top and bottom edges, wherein the head members are configured to attach to the connection points near the top edge. The cables may be configured to attach to the connection points near the bottom edge of the tarp. The poles may be configured to each guide a respective cable. The two pole attachment members may each be configured to attach a respective pole to a location on the roof below the ridge of the roof. The winches may each be configured to apply tension to a respective cable, thereby suspending the tarp above the roof.

20 Claims, 6 Drawing Sheets

(56) References Cited

U.S. PATENT DOCUMENTS 8,572,901 B2 * 11/2013 Holstrom ..... C05F 17/0258
135/119
9,506,268 B1 * 11/2016 Bright ..... E04H 15/02

* cited by examiner

MODULAR TEMPORARY ROOF COVERING SYSTEMS

BACKGROUND

The present disclosure relates generally to temporary roof coverings. In particular, modular temporary roof covering systems are described.

During construction and maintenance of roofed structures, it may be desirable to temporarily cover the roof the structure. For example, when replacing the shingles and/or roof sheathing of a shingled home, it may desirable to shield the interior of the home from the elements e.g., rain, sun, leaves and other debris, etc. Known temporary roof coverings are not entirely satisfactory for the range of applications in which they are employed.

The most common existing method of protecting against the elements when replacing a roof is to simply lay a sheet of plastic or a tarp across the roof substructure and attempt to secure the edges of the plastic or tarp using nails or other common fasteners. This crude method of protecting against the elements has many limitations and drawbacks. For example, handling an untethered large tarp/plastic sheet while on top of a roof is dangerous and awkward, especially in high winds. Additionally, the tarp/plastic may be ripped free rather easily by the wind.

Another significant draw back to the conventional tarp/plastic sheet covering method is that work cannot be performed while the covering is in place. Thus, the tarp/plastic sheet must be removed and replaced at the beginning and end of each work day, and a rainstorm will halt work altogether. Furthermore, penetrating the roof fascia or soffit with nails may result in aesthetic damage. Thus, there exists a need for temporary roof coverings that improve upon and advance the design of known temporary roof coverings. Examples of new and useful roof coverings relevant to the needs existing in the field are discussed below.

SUMMARY

In one embodiment, a roof covering system includes at least two ridge post members, a tarp at least two cables, at least two poles, at least two pole attachment members, and at least two winches. Each ridge post member may include a base configured to attach to a ridge of a roof, a head member; and a post having a bottom end and a top end, the bottom end secured to the base, and the top end secured to the head member. The tarp may have a top edge and a bottom edge, and connection points disposed near the top and bottom edges, wherein the head members are configured to attach to the connection points near the top edge. The cables may be configured to attach to the connection points near the bottom edge of the tarp. The poles may be configured to each guide a respective cable. The two pole attachment members may each be configured to attach a respective pole to a location on the roof below the ridge of the roof. The winches may each be configured to apply tension to a respective cable, thereby suspending the tarp above the roof.

DETAILED DESCRIPTION

Figure 1:
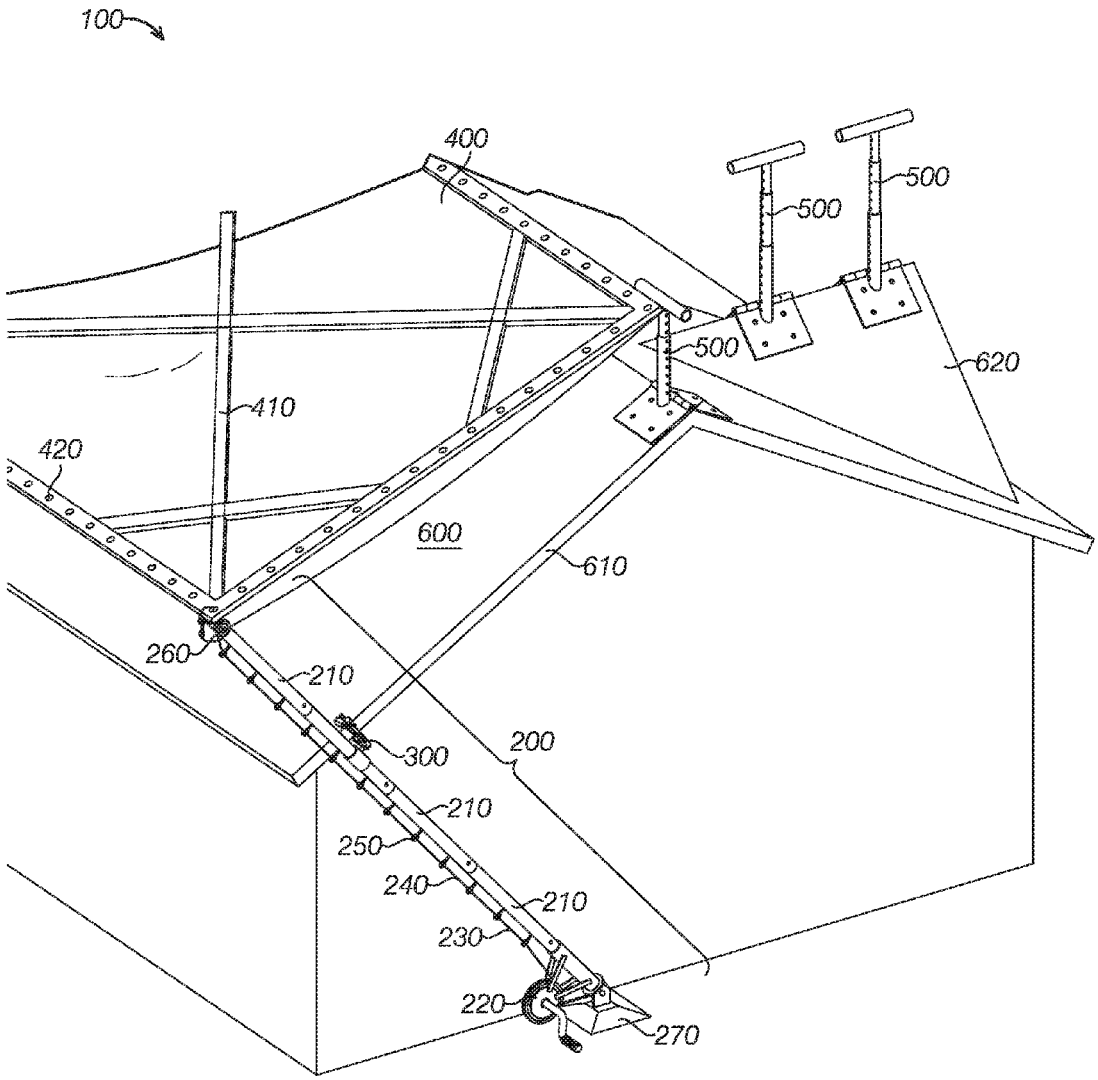
FIG. 1 is a perspective view of a first example of a modular temporary roof covering system.

The disclosed temporary roof coverings will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various temporary roof coverings are provided. related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-9, a first example of a modular temporary roof covering system, system 100, will now be described. System 100 functions to cover. The reader will appreciate from the figures and description below that system 100 addresses shortcomings of conventional temporary roof coverings.

For example, system 100 is easy and safe to deploy, even in windy conditions. Furthermore, once system 100 has been deployed, it is secure against the wind. Additionally, system 100 may be left in place while work occurs underneath, thus allowing roofing work to continue uninterrupted even in heavy rainstorms. Finally system 100 is modular, making it easy to scale the system up or down depending on the size of the structure to be covered.

System 100 includes ridge post members 500, a tarp 400, poles 200 to guide cables 240, pole attachment members 300 to attach the poles to a roof structure, ground anchors 270 to anchor the poles, and one or more winches 220 to tension the cables 240. Poles 200 may comprise modular pole members 210 connected end to end. Each ridge post member 500 may comprise a base 510, a head member 520, and a post 502.

FIG. 1 illustrates one side of the system 100, including a ridge post member 500 securing one upper corner of tarp 400, and pole 200 securing one lower corner of tarp 400. The other side of system 100 (not pictured) may be substantially similar to the illustrated side. For example the other side of system 100 may be essentially a mirror image of the illustrated side. In other embodiments, the other side may include additional ridge post members or a pole placed in a different configuration relative to the roof, depending on the configuration of the other side of the roof.

As illustrated in FIG. 1, the ridge post member 500 securing the tarp may be secured to the ridge lines of roof structure 600. As can be seen on the right side of FIG. 1, for illustrative purposes, additional ridge post members 500 are shown secured to the ridge of a gable 620. This configuration may be useful, for example, to stand the tarp off gable 620 when, for example, a roofing crew using system 100 is ready to switch the tarp to that side of the roof.

Pole 200 functions to secure a lower corner of tarp 400 via cable 240. To deploy system 100, a user may secure the upper corners of tarp 400 to ridge post members 500 and the lower corners to of tarp 400 to poles 200 via cables 240. Then cables 240 may be tensioned via winches 220, thereby stretching tarp 400 taught over roof 600. Ridge post members 500 may be telescoping, and thus adjustable in height. Similarly, poles 200 may be comprised of modular pole members 210, and thus the length of poles 200 may be adjusted by adding or removing modular pole members. Furthermore, by adjusting the placement of pole attachment member 300, and/or the placement of ground anchor 270, the angle of the pole may be adjusted. Therefore, the pitch of tarp 400 may be adjusted as desired. Furthermore the height of tarp 400 off the surface of roof 600 may be adjusted as desired. In this manner, system 100 allows workers to work on roof 600 even with tarp 600 in place. Thus, system 100 allows for roofing work to continue, uninterrupted during rainstorms.

As can be seen in FIG. 1, tarp 400 may include reinforced grommets 420 along the perimeter to allow the tarp to connect to cable 240 and/or head member 520 of ridge post member 500. Tarp 400 may comprise reinforcing 410 to prevent the tarp from tearing.

Figure 2:
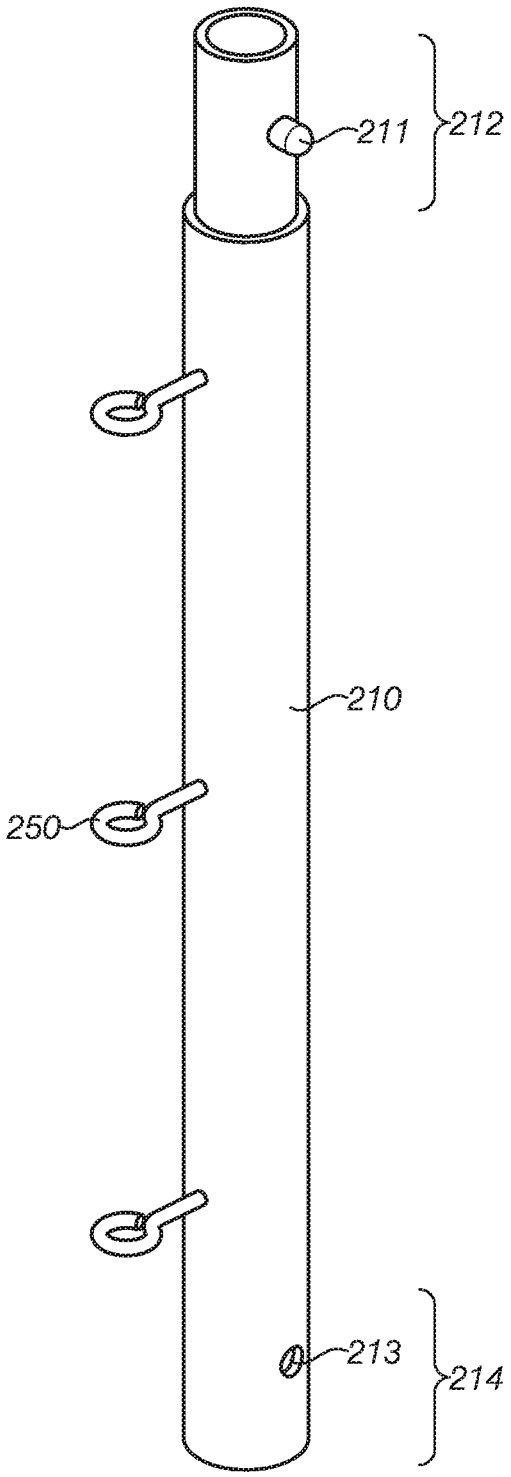
FIG. 2 is a side view of a modular pole member in accordance with the embodiment of FIG. 1.

Turning to FIG. 2, one embodiment of a modular pole member 210 is shown. Pole member 210 includes a male end 212 and a female end 214. The male end 212 is configured to mate with the female end of another modular pole member. For example male end 212 may have a stepped shoulder and smaller diameter configured to slide into the male end of another pole member. Male end 212 may include a spring-loaded pin connector 211. The pin connector 211 may be depressed to allow male end 212 to be inserted into a female end of another pole member. Pin connector 211 may then spring into place once aligned with a hole in the female end. Thus, female end 214 includes such a hole, hole 213 to accept a pin connector of another pole member.

In the illustrated embodiment, modular pole member 210 comprises circular hollow tubes. In other embodiments (not pictured), the modular pole members may comprise other tubular members having any other suitable shape(s). For example, in one embodiment, the modular pole members may comprise square tubing. In other embodiments, the modular pole members may comprise rectangular tubing.

Modular pole members may be made of a material having sufficient strength to support the cable and the tarp. For example, the modular pole members may comprise a structural steel, aluminum and/or other metal material. In other embodiments, the modular pole members may comprise polymer materials including polyethylene, PVC, and/or polypropylene, among many others.

Modular pole member 210 may include one or more cable guides 250. Cable guides 250 function to guide cable 240 down the length of the pole 200. In the illustrated embodiment, the cable guides 250 are shown as eyelets. In other embodiments, the cable guides may comprise grooves, flexible hose, and/or an interior channel within the pole member 210.

Figure 3:
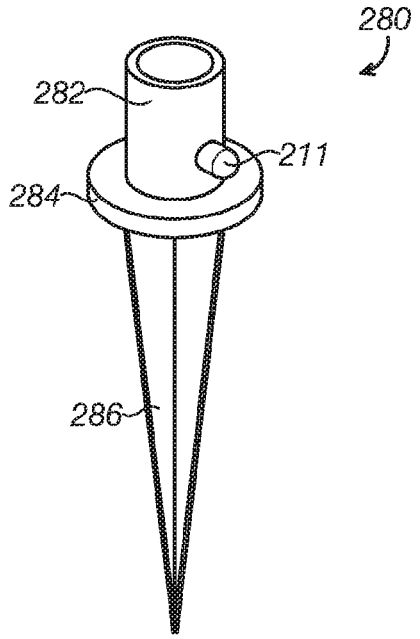
FIG. 3 is a side view of a spike type ground anchor in accordance with the embodiment of FIG. 1.

Turning now to FIG. 3, one embodiment of a ground anchor, ground anchor 280 is shown. Ground anchor 280 comprises a downward pointing spike 286, a collar 284 and a male end 282. The spike 286 functions to penetrate the ground. Male end 282 is configured to be inserted into a female end of a pole member. Collar 284 functions to prevent the spike 286 from being driven too far into the ground and to prevent the male end from being inserted too far into female end. Male end 282 includes a spring-loaded pin connector, as described above.

Figure 4:
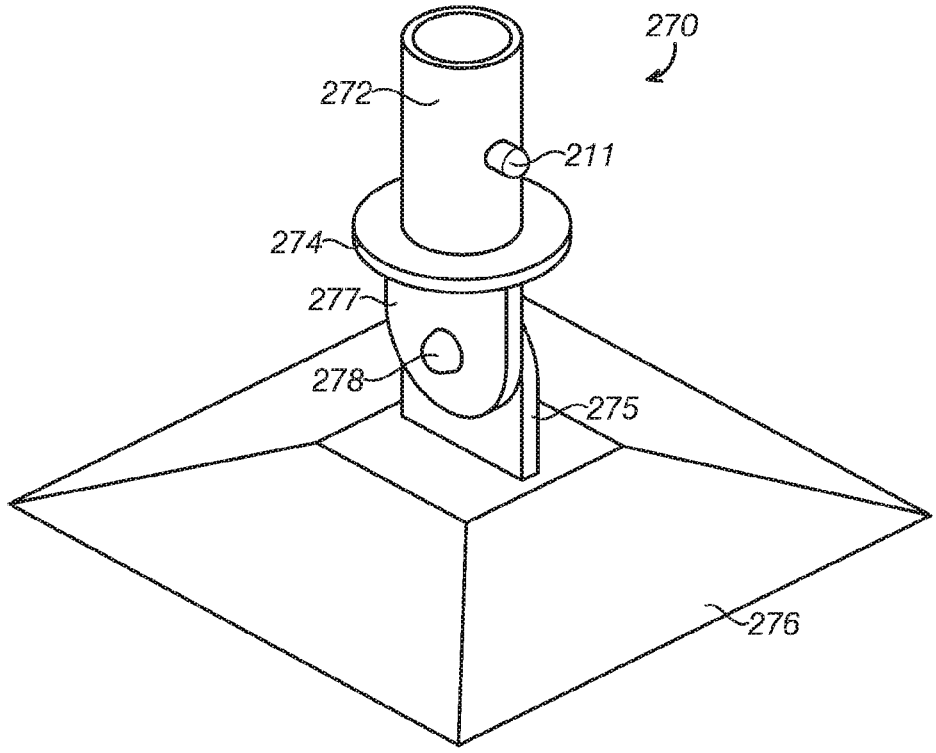
FIG. 4 is a side view of a foot type ground anchor in accordance with the embodiment of FIG. 1.

Turning now to FIG. 4, a second embodiment of a ground anchor, ground anchor 270 is shown. Ground anchor 270 comprises a base plate 276 connected to a male end 272 via an articulable elbow. The elbow comprises an upper arm 277 joined to a lower arm 275 via a pivot 278. Pivot 278 may be selectively lockable, for example, via a wing nut (not pictured). Further, the abutting faces of the lower arm 275 and upper arm 277, respectively, may include interlocking teeth to prevent rotation of the elbow when the wingnut is tightened.

Ground anchor may include a collar 274 to prevent male end 272 from being inserted too far into a female end of a pole member. Male end 272 may include a spring-loaded pin connector, as described above. In other embodiments (not pictured), the ground anchor may comprise one or more containers configured to hold an amount of water.

Figure 5:
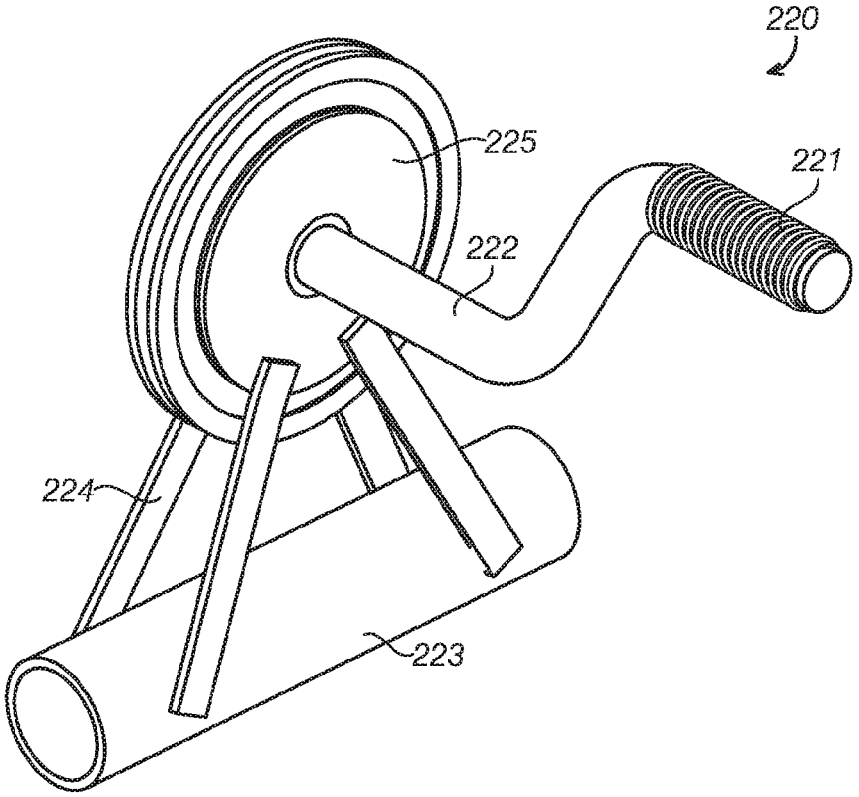
FIG. 5 is a side view of a winch in accordance with the embodiment of FIG. 1.

Turning now to FIG. 5, one embodiment of winch, winch 220 is shown. The winch may include a main body 225, legs 224, a sleeve 223 and a handle 222 having a grip 221. The handle functions to wind the winch in order to tension the cable 240. The sleeve is configured to slide over pole 200 in order to secure the winch to any point along the pole 200.

Figure 6:
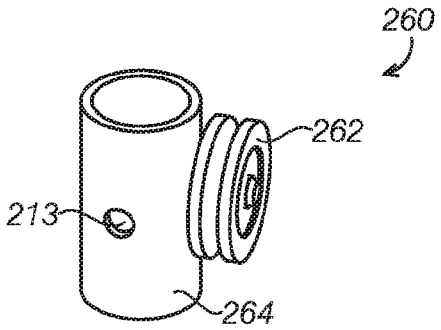
FIG. 6 is a side view of a pulley cap in accordance with the embodiment of FIG. 1.

Turning now to FIG. 6, a pulley cap 260 is shown. In the illustrated embodiment, pulley cap includes a female end 264 and pulley 262. Female end 264 is configured to accept the male end of a pole member. Female end 264 may include a hole 213 to accept the spring-loaded pin connector a male end. Pulley 262 functions to guide cable 240 from the tip of pole 200 to the tarp 400.

Figure 7:
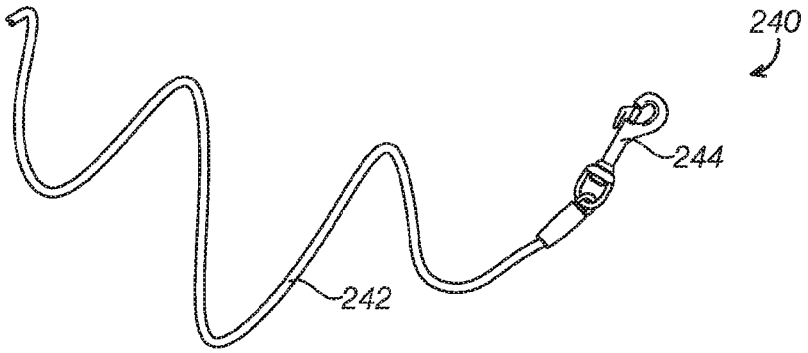
FIG. 7 is a perspective view of a cable in accordance with the embodiment of FIG. 1

Turning now to FIG. 7, cable 240 is shown. Cable 240 may include a clip 244 and cord 242. Clip 244 functions to attach to tarp 400. Cord 242 may comprise a polymer such as nylon, polyethylene, and or Kevlar, among many others. Cord 242 may alternatively or additionally comprise metal wire.

Figure 8:
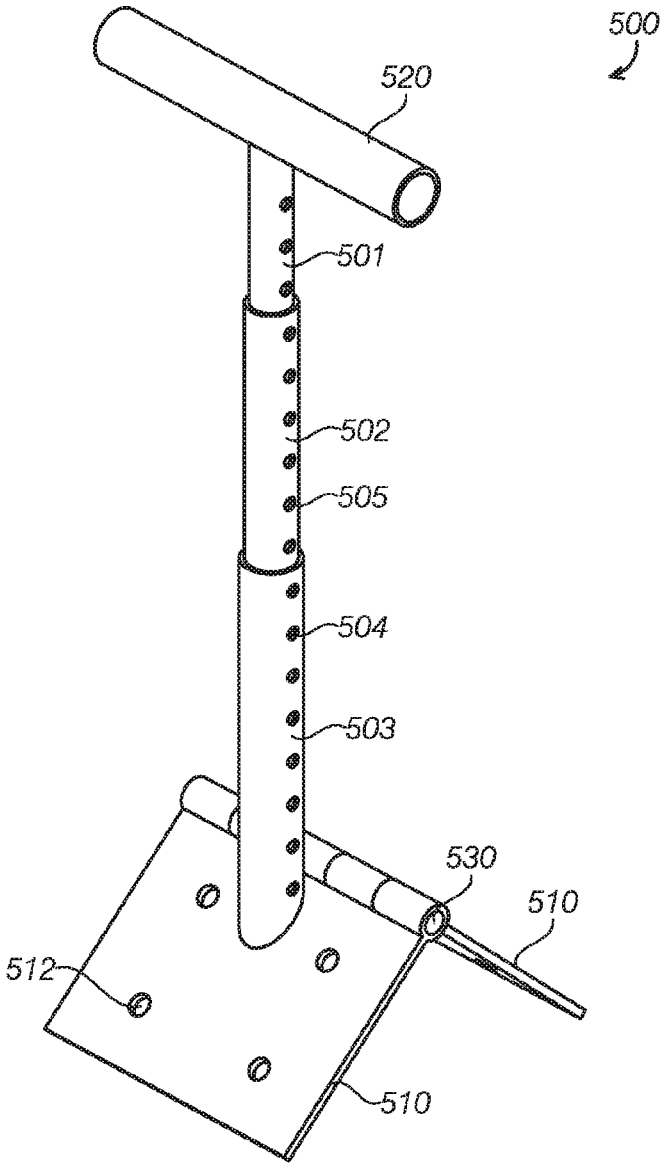
FIG. 8 is a side view of a ridge post member in accordance with the embodiment of FIG. 1.

With reference to FIG. 8, Ridge post member 500 may comprise telescoping members 501, 502, 503. Lower telescoping member 503 may include a series of holes 504. Middle telescoping member 502 may include a spring-loaded pin connector configured to mate with any one of the series of holes 504, thereby securing the lower and middle telescoping members 503, 502 to each other. Depressing the spring loaded pin connector may allow the telescoping members to once again slide relative to each other. In this regard, the height of ridge post member 500 may be adjustable.

In a similar manner, middle telescoping member may include a series of holes 505 and upper telescoping member 501 may include a spring-loaded pin connector. Thus the upper and middle telescoping members 501, 502 may be adjustable relative to each other. In some embodiments, the spacing between holes 505 may be different than the spacing between holes 504. For example the spacing between holes 504 may be larger than the spacing between holes 505. In this regard, the ridge post member may feature a rough height adjustment via holes 504 and fine height adjustment via holes 505.

In the illustrated embodiment ridge post member 500 comprises three telescoping members. In other embodiments, the ridge post member may have more or less telescoping members. Furthermore, in some embodiments, the telescoping members may be secured to each other via clamps or other means, instead of or in addition to the spring-loaded pin member.

Ridge post member 500 includes a base. In the illustrated embodiment, the base includes a pair of attachment plates 510. In some embodiments, the attachment plates 510 may be placed with one plate on each side of the ridge of a roof. The attachment plates 510 may be joined by a hinge 530. In this manner, the angle formed by the attachment plates may be adjusted to match the angle formed by the two roof pitches at the ridge.

Each attachment plate 510 may include a plurality of holes 512 configured to receive fasteners. In some embodiments, the fasteners may comprise ring shank nails. The ridge post member may further include a head member 520. The head member 520 is supported by the telescoping post members 501, 502, 503. Head member 520 may have a rounded profile to avoid damage to the tarp 400.

Figure 9:
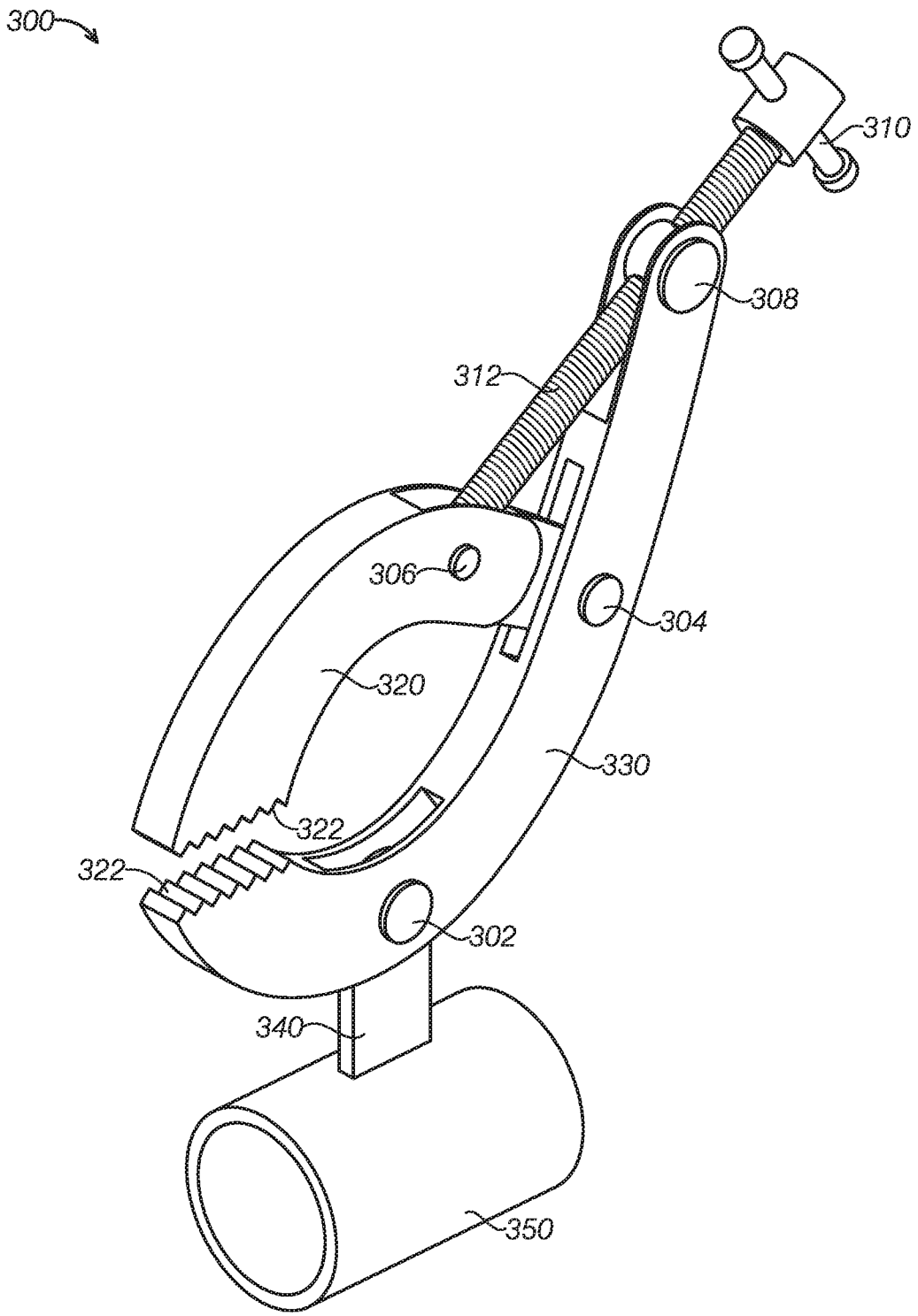
FIG. 9 is a side view of a pole attachment member in accordance with the embodiment of FIG. 1.

Turning now to FIG. 9, one embodiment of a pole attachment member, pole attachment member 300 is shown. Pole attachment member 300 comprises a clamp 330 connected to a sleeve 350 via a pivoting connector 340. In the illustrated embodiment the pivoting connector is connected to clamp 330 via a pivot 302.

Clamp 330 comprises an upper jaw 320, opposing teeth 322, pivots 306 and 304, threaded shaft 312, threaded pivot 308 and handle 310. By turning the handle 310, the threaded shaft extends, pushing against the threaded pivot and causing the jaws to close. Thus, the jaws may be clamped to roof edge 610.

Sleeve 350 is configured to grip pole 200 in order to secure the pole 200 against the roof. The pivoting connector 340 allows the angle of the pole 200 to be adjusted with respect to the roof edge 610.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A roof covering system, comprising:

at least two ridge post members, each ridge post member comprising:

a base configured to attach to a ridge of a roof;

a head member; and a post having a bottom end and a top end, the bottom end secured to the base, and the top end secured to the head member;

a tarp having a top edge and a bottom edge, the tarp comprising connection points disposed along the top and bottom edges, wherein the head members are configured to attach to the connection points along the top edge;

at least two cables configured to attach to the connection points along the bottom edge of the tarp;

at least two poles, each pole configured to guide a respective cable;

at least two pole attachment members, each pole attachment member configured to attach a respective pole to a location on the roof below the ridge of the roof; and at least two winches, each winch configured to apply tension to a respective cable, thereby suspending the tarp above the roof.

2. The roof covering system of claim 1, wherein each post is extendable such that a distance from the base to the head member may be adjusted.

3. The roof covering system of claim 1, wherein the base comprises an attachment plate including a plurality of holes configured to receive fasteners.

4. The roof covering system of claim 3, wherein the attachment plate is a first attachment plate, the base comprising a second attachment plate, and wherein the first and second attachment plates are joined via a hinge such that an angle between the attachment plates may be adjusted to correspond to an angle formed by a first roof pitch meeting a second roof pitch at the ridge of the roof.

5. The roof covering system of claim 1, wherein each pole is comprised of modular pole members, each modular pole member having a male end and a female end, wherein the female end is configured to receive the male end of another modular pole member, and wherein the male end is configured to be received by the female end of another modular pole member.

6. The roof covering system of claim 5, wherein each male end includes a spring loaded pin connector and each female end includes a corresponding hole to receive the pin connector.

7. The roof covering system of claim 1, wherein each pole includes a plurality of eyelets configured to guide one said cable.

8. The roof covering system of claim 1, wherein each pole is configured to guide at least one said cable through an interior channel of the respective pole.

9. The roof covering system of claim 1, comprising at least two ground anchors, each ground anchor configured to anchor a respective pole to the ground.

10. The roof covering system of claim 9, wherein each ground anchor comprises a spike configured to be driven into the ground.

11. The roof covering system of claim 9, wherein each ground anchor comprises a container configured to hold an amount of water.

12. The roof covering system of claim 1, wherein the connection points of the tarp comprise reinforced grommets.

13. The roof covering system of claim 1, wherein each pole attachment member comprises:

a clamp configured to clamp an edge of the roof;

a guide configured to retain the pole; and a pivoting connector joining the clamp to the guide.

14. The roof covering system of claim 1, wherein each winch is attached to a respective pole.

15. A roof covering system comprising:

at least two ridge post members, each ridge post member comprising:

a base configured to attach to a ridge of a roof;

a head member; and a post having a bottom end and a top end, the bottom end secured to the base, and the top end secured to the head member, post members is extendable such that a distance from the base to the head member may be adjusted;

a tarp having a top edge and a bottom edge, the tarp comprising connection points disposed along the top and bottom edges, wherein the head members are configured to attach to the connection points along the top edge;

at least two cables configured to attach to the connection points along the bottom edge of the tarp;

at least two poles, each pole configured to guide a respective cable;

at least two ground anchors, each ground anchor configured to anchor a respective pole to the ground;

at least two pole attachment members, each pole attachment member configured to attach a respective pole to a location on the roof below the ridge of the roof; and at least two winches, each winch configured to apply tension to a respective cable, thereby suspending the tarp above the roof.

16. The roof covering system of claim 15, wherein the base comprises an attachment plate including a plurality of holes configured to receive fasteners.

17. The roof covering system of claim 16, wherein the attachment plate is a first attachment plate, the base comprising a second attachment plate, and wherein the first and second attachment plates are joined via a hinge such that an angle between the attachment plates may be adjusted to correspond to an angle formed by a first roof pitch meeting a second roof pitch at the ridge of the roof.

18. The roof covering system of claim 15, wherein each pole is comprised of modular pole members, each modular pole member having a male end and a female end, wherein the female end is configured to receive the male end of another modular pole member, and wherein the male end is configured to be received by the female end of another modular pole member.

19. The roof covering system of claim 18, wherein each male end includes a spring loaded pin connector and each female end includes a corresponding hole to receive the pin connector.

20. The roof covering system of claim 19, wherein each pole includes a plurality of eyelets configured to guide one said cable.

* * * * *